US005897167A

United States Patent [19]

Keith

[11] Patent Number: 5,897,167

[45] Date of Patent: Apr. 27, 1999

[54] DETACHABLE ADJUSTABLE HEIGHT HEADREST FOR A FOLDING CHAIR

[76] Inventor: Lendon V. Keith, 3590 Round Bottom Rd., Suite F-60604, Cincinnati, Ohio 45244-3000

[21] Appl. No.: 09/162,138

[22] Filed: Sep. 29, 1998

Related U.S. Application Data

[XX .
[60] Provisional application No. 60/065,257, Nov. 20, 1997.

[51] Int. Cl.[6] ..... A47C 7/38
[52] U.S. Cl. ..... 297/397; 297/410
[58] Field of Search ..... 297/391, 397, 297/410

[56] References Cited

U.S. PATENT DOCUMENTS

| | | | |
|---|---|---|---|
| 319,980 | 6/1885 | Koenig | 297/397 |
| 2,638,152 | 5/1953 | Pulsifer . | |
| 2,905,230 | 9/1959 | Gabriel . | |
| 3,851,919 | 12/1974 | Nagy . | |
| 3,861,741 | 1/1975 | Kaufman | 297/410 |
| 4,030,781 | 6/1977 | Howard . | |
| 4,607,886 | 8/1986 | Mazhar . | |
| 4,619,483 | 10/1986 | Dickey et al. . | |
| 4,711,492 | 12/1987 | Asbjornsen et al. . | |
| 4,828,287 | 5/1989 | Siler . | |
| 5,328,244 | 7/1994 | Ishihara et al. | 297/397 |
| 5,378,041 | 1/1995 | Lee | 297/391 |

FOREIGN PATENT DOCUMENTS

| | | | |
|---|---|---|---|
| 2847745 | 5/1980 | Germany | 297/410 |

*Primary Examiner*—Peter M. Cuomo
*Assistant Examiner*—Anthony D. Barfield
*Attorney, Agent, or Firm*—Richard C. Litman

[57] ABSTRACT

A detachable, adjustable headrest device for a folding chair can be used either with a recreational vehicle or on a lawn chair. The headrest device comprises a U-shaped tubular bracket supporting a corresponding geometric plate having two vertical parallel slots. A planar rectangular plate having two threaded bolts supports a rectangular block of foam padding covered by a plastic sheet. The plate and covered padding fasten to the bracket through the parallel slots, which provide for vertical adjustment. The bottom portions of the tubular bracket are adapted to fit onto the top portion of a folding chair with a tubular metal frame by friction-fitting cutouts.

7 Claims, 3 Drawing Sheets

DETACHABLE ADJUSTABLE HEIGHT HEADREST FOR A FOLDING CHAIR

CROSS-REFERENCE TO RELATED APPLICATION

This application claims the benefit of U.S. Provisional Patent Application Ser. No. 60/065,257, filed Nov. 20, 1997.

BACKGROUND OF THE INVENTION

1. Field of the Invention

The present invention relates to headrests and, more specifically, to a detachable, adjustable-height headrest device for a folding chair.

2. Description of Related Art

The related art describes various headrests for chairs and the like. The art of interest will be discussed in the order of perceived relevance to the present invention.

U.S. Pat. No. 4,030,781 issued on Jun. 21, 1977, to Harold P. Howard describes a headrest for a lawn chair having an adjustable height means and a quick release design. A rectangular pillow block is supported by a plastic or metal rectangular plate attached by a pair of welded brackets and screws to two vertical parallel flat strips or rods formed from two sets of rods. The rods are adjustable in height due to the selection and fastening by screws and nuts of two apertures in a row of apertures in the rear rod and two apertures in the front rod. The bottom pair of rods end in a hook member cutout and bent to engage the horizontal rear member of the tubular seat frame. The rods are further interlaced with the webbing of the seatback. The headrest is distinguishable for the difference in the point of attachment to a lawn chair and the use of adjustable rods rather than the slotted panel behind the headrest of the present invention.

U.S. Pat. No. 4,607,886 issued on Aug. 26, 1986, to Mike S. Mazhar describes a headrest for placement against the rear window and its support plate behind a truck seat. A septehedronal foam plastic head cushion is supported on its lower edge by a flange of the support plate. Below the cushion, two vertical slots are present in the support plate for fastening of the plate to the rear panel of a truck cab by a pair of knobbed screws. The upper rear edge of the support plate has a pair of pads for resting the support plate against the cab window. The headrest is distinguishable for the difference in the height adjustment of the support plate relative to the seat back rather than the height adjustment of the headrest relative to the support plate as in the present invention.

U.S. Pat. No. 4,619,483 issued on Oct. 28, 1986, to Donna J. Dickey et al. describes a shoulder support for attachment to a chair back for a physically handicapped person. A support plate shaped like a silhouette of a flat-faced human head and neck supports a padded headrest and an elongated pad for a hip bolster. The support plate is either hung by rod connectors on the back of a reclining chair or by bolts to a side of the chair. The headrest can be adjusted in height by bolts in a slot in the support plate. The shoulder support is distinguishable for its reliance in positioning the headrest and its support plate to a side of a chair instead of on the back of a chair.

U.S. Pat. No. 2,638,152 issued on May 12, 1953, to Newell B. Pulsifer describes a headrest for a chair back to rest a side of a head. An adjustable seatback bracket consists of a rear leg and a forward leg which supports an L-shaped bracket in a vertical slot. The L-shaped bracket then supports an oval-shaped pad by, a removable fastener. The headrest is distinguishable for its plurality of brackets for alignment with the side of a head.

U.S. Pat. No. 2,905,230 issued on Sep. 22, 1929, to Edward J. Gabriel describes a chair with an adjustable headrest. The headrest can be adjusted in height by being contained by a pair of loops in a pair of vertical channels in a seatback closed by zippers. The headrest is distinguishable for the structure bears little resemblance to that of the present invention.

U.S. Pat. No. 4,711,492 issued on Dec. 8, 1987, to Svein Ashjornsen et al. describes a split chair back for a slidable knobbed headrest and a back rest. The headrest is distinguishable for a structure dissimilar to the structure of the present invention.

U.S. Pat. No. 3,851,919 issued on Dec. 3, 1974, to James P. Nagy describes an automobile headrest which is hung on the inside of a window from a vertical bracket having a slot for adjustment in height of an upper positioned spacer (resting against the window) and of a curved head support positioned below. The headrest is distinguishable for its different structural features.

U.S. Pat. No. 4,828,287 issued on May 9, 1989, to Joseph Siler describes a safety head protector for vehicles. A square pad of foam plastic or rubber on a wooden back is covered by a plastic cover and attached to the rear window of a truck cab by hook and loop fasteners. The protector is distinguishable for its different structural features.

None of the above inventions and patents, taken either singly or in combination, is seen to describe the instant invention as claimed.

SUMMARY OF THE INVENTION

The present invention is a detachable, adjustable-height headrest device for a folding chair, used with either a recreational vehicle or a lawn chair, and comprising a U-shaped tubular bracket supporting a correspondingly geometric flat curvilinear plate having two vertical parallel slots. A planar rectangular plate with two threaded bolts supports a rectangular block of padding covered by a plastic sheet. The plate and covered padding are fastened to the bracket through the parallel slots for vertical adjustment. The bottom portions of the tubular bracket are adapted to fit onto the top portion of a folding chair with a tubular metal frame.

Accordingly, it is a principal object of the invention to provide a removable headrest device for a folding chair.

It is another object of the invention to provide an adjustable-height headrest device for a folding chair.

It is a further object of the invention to provide a headrest device which can be placed on a straight back of a folding chair without necessarily resorting to fasteners.

Still another object of the invention is to provide a headrest device which is an extension of the back of a folding chair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a detachable, adjustable-in-height padded headrest device for a folding chair associated with recreational vehicles or for a lawn chair, for example.

Figure 1:
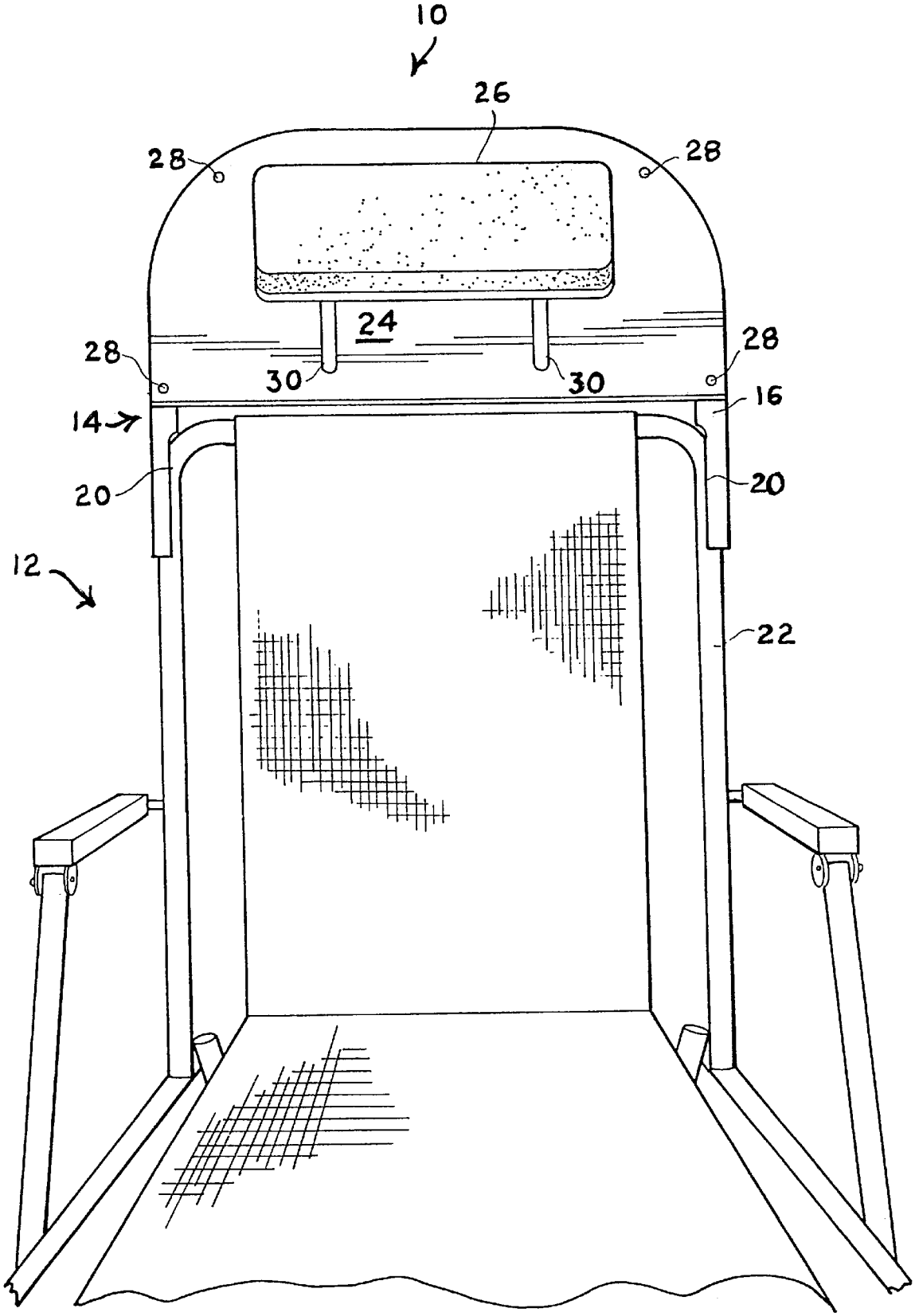
FIG. 1 is an environmental perspective front view of the headrest device attached to a folding chair shown partially.
Figure 2:
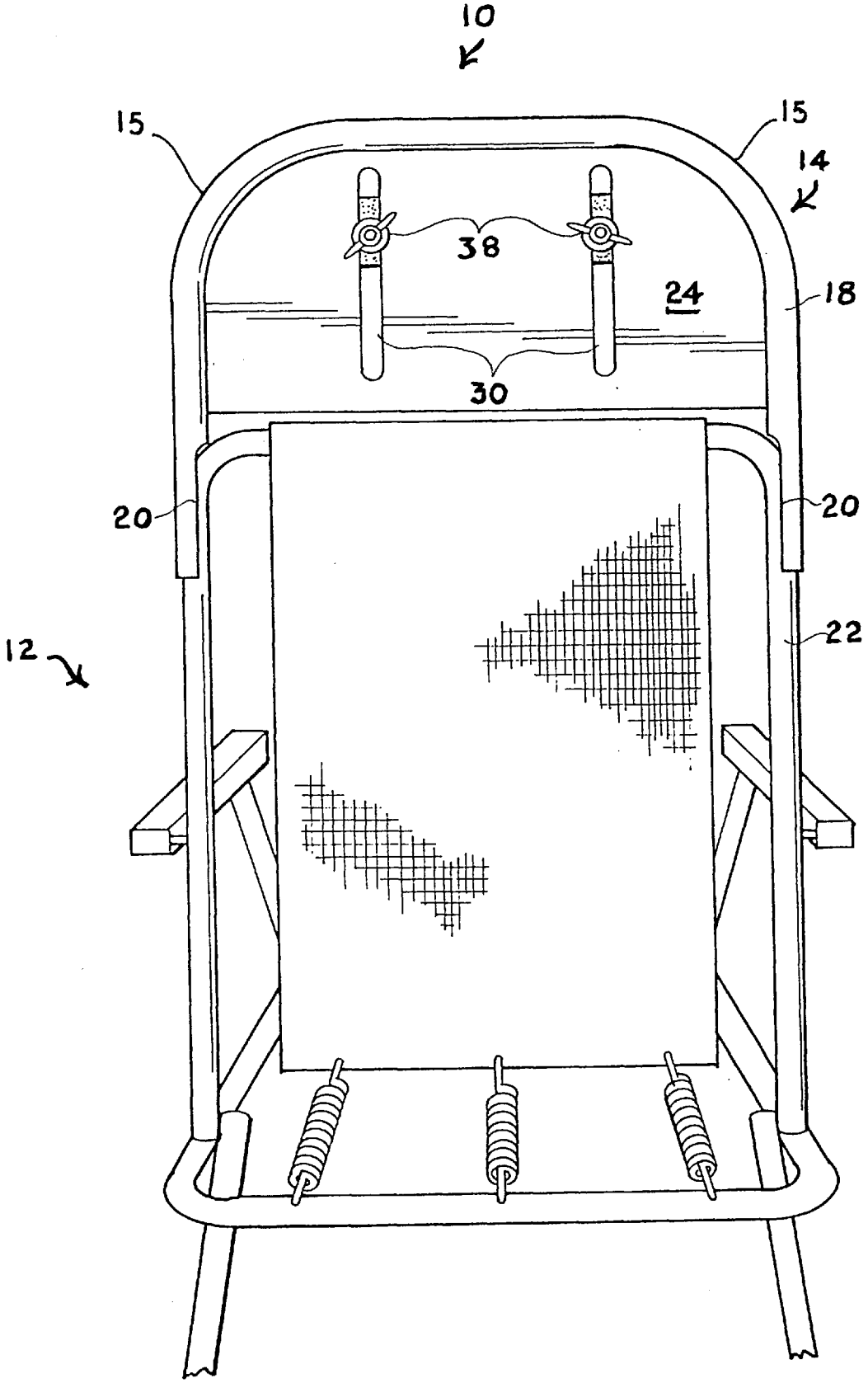
FIG. 2 is an environmental perspective rear view of the headrest device attached to the folding chair of FIG. 2.
Figure 3:
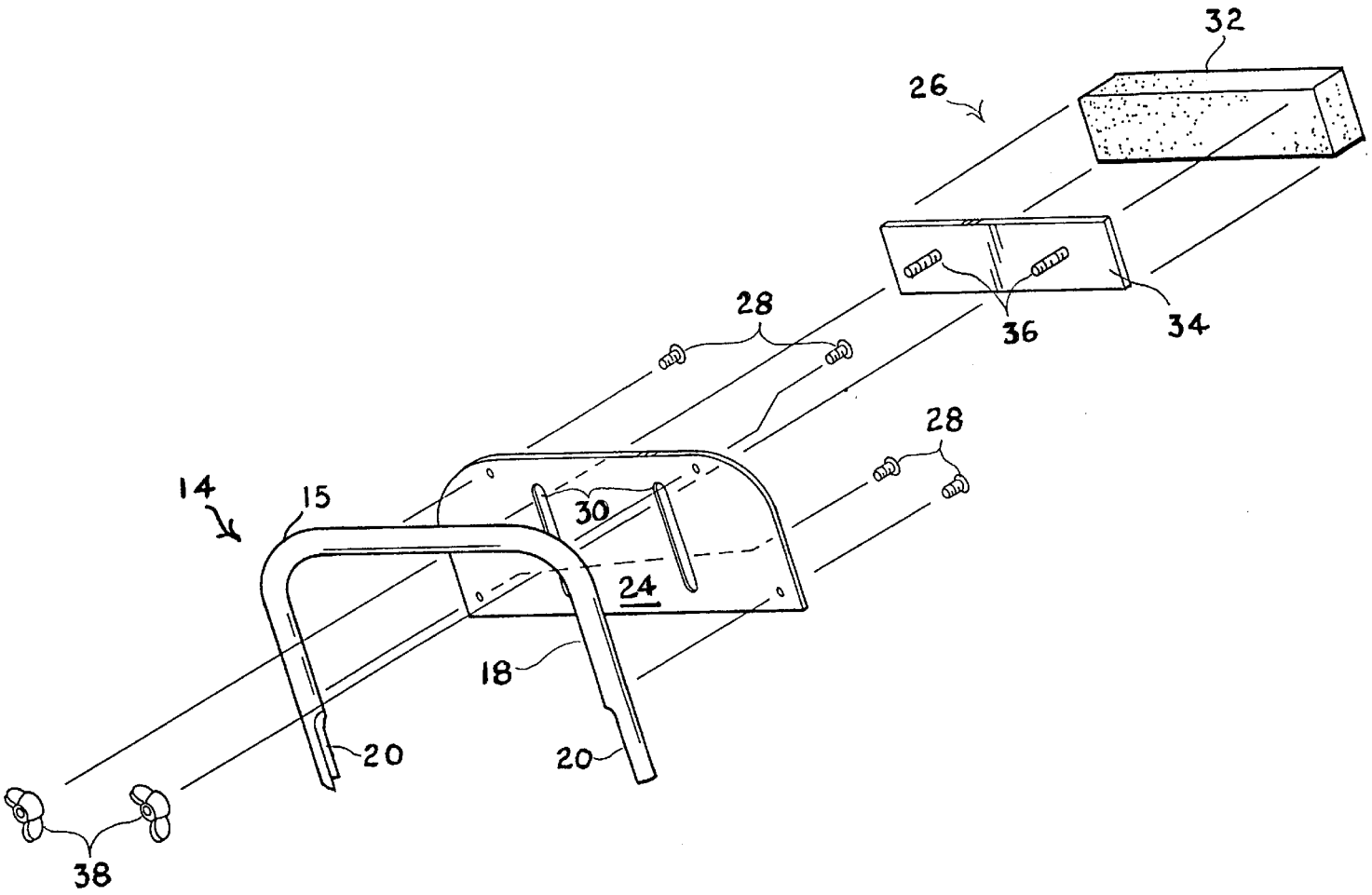
FIG. 3 is an exploded view of the headrest device.

FIG. 1 is a front view of the headrest device 10 positioned on a folding chair 12 (shown partially). FIG. 2 is a rear view of the headrest device 10 on the folding chair 12. FIG. 3 is an exploded view of the headrest device 10 showing the various parts. These figures will be discussed together.

The headrest device 10 is based on a tubular and curvilinear frame 14 which is U-shaped and has a front surface 16 and a rear surface 18. The tubular frame 14 is curved at the upper corners 15, and has socket means or cutouts 20 on the inside surfaces of each end. These socket means or cutouts 20 are unique in being able to friction-fit the seatback frame 22 without fastening, However, it is within the ambit of the present invention that fasteners such as screws can be utilized.

A substantially rectangular metal plate 24 configured to follow the geometry of the top portion of the U-shaped frame 14 is the base for the headrest element 26. Metal plate 24 is fastened by fasteners 28 such as bolts (or rivets) to the frame 14. Two vertical and parallel slots 30 are formed in the frame 14.

The headrest element 26 is formed by a rectangular pad 32 made of foam rubber covered by a vinyl sheet and secured by any means to a front surface of a rectangular metal plate 34 having the same planar area. The plate 34 has a pair of threaded metal studs 36 extending from its rear surface, spaced to slide in the slots 30 of the metal plate 24 and secured by wingnuts 38 and washers (not shown).

The headrest device 10 can be readily attached by friction fit or otherwise to the upper seatback frame 22 of a folding chair 12, be it a chair for recreational vehicles or a lawn chair, and the headrest element 26 can be readily adjusted for the height of the user's head by utilizing the wingnuts 38.

Exemplary dimensions and materials for the headrest device 10 are as follows:

Tubular U-shaped frame 14: stainless steel, aluminum or chromed pipe, ¾ in. diameter, 18 3/16 in. width, 18 in. height, and 4 in. of legs exposed with ¾ in. cut out for cutouts 20.

Headrest plate 24: 3/16 in. thick aluminum, 18 3/16 in. width, 14 in. height, rounded corners on top, and with slots 30 being 6½ in. long and ⅜ in. wide.

Headrest element 26: sponge rubber pad 32 covered by a vinyl sheet, 10 in. long, 4 in. wide and several in. thick; aluminum pad plate 34 with two 5/16 in. diameter threaded metal studs 36, and washers and wingnuts 38.

It is to be understood that the present invention is not limited to the sole embodiment described above, but encompasses any and all embodiments within the scope of the following claims.

It is further understanding that major components could be made of plastic or hard plastic in place of the metal parts listed above.

I claim:

1. A detachable, adjustable height headrest device for a folding chair comprising:

a U-shaped tubular frame having a front surface and a rear surface, and having legs with ends, there being a socket means defining an inside cutout at each said leg end;

a substantially rectangular plate having a width commensurate with and a height shorter than said U-shaped tubular frame, and removably attached to said front surface of said U-shaped tubular frame, said substantially rectangular plate having a pair of parallel vertical slots; and a rectangular pad having a front surface and a rear surface, and a pair of studs and fasteners on said pad rear surface for removable attachment to said pair of parallel vertical slots of said substantially rectangular plate; whereby said headrest can be attached to a folding chair having a straight back portion at a top of said straight back portion, by sliding down tubular sides of said folding chair and adjusting a height of said rectangular pad vertically on said substantially rectangular plate.

2. The headrest device according to claim 1, including wing nuts for said fasteners of said pair of studs.

3. The headrest device according to claim 1, including said socket means defining said inside cutout at each said leg end for friction fitting a seatback frame of a folding chair without fasteners.

4. The headrest device according to claim 1, wherein said substantially rectangular plate has upper rounded corners and being made of metal.

5. The headrest device according to claim 4, including fasteners selected from the group consisting of bolts and rivets for fastening said substantially rectangular plate to said U-shaped tubular frame.

6. The headrest device according to claim 1, wherein said rectangular pad comprises a rectangular metal plate supporting a rectangular resilient pad.

7. The headrest device according to claim 6, wherein said rectangular resilient pad comprises a foam rubber pad covered by a vinyl sheet.

* * * * *